US006450541B1

(12) United States Patent
Bakke

(10) Patent No.: US 6,450,541 B1
(45) Date of Patent: Sep. 17, 2002

(54) RELEASABLE CONNECTOR

(75) Inventor: Stig Bakke, Ålgård (NO)

(73) Assignee: Bakke Technology AS, Algard (NO)

( * ) Notice: Subject to any disclaimer, the term of this patent is extended or adjusted under 35 U.S.C. 154(b) by 0 days.

(21) Appl. No.: 09/652,646

(22) Filed: Aug. 31, 2000

(30) Foreign Application Priority Data

Aug. 30, 1999 (NO) ..... 19994188

(51) Int. Cl.[7] ..... F16L 35/00
(52) U.S. Cl. ..... 285/2; 285/83; 285/306
(58) Field of Search ..... 285/1, 2, 34, 83, 285/306, 33, 35, 102, 900, 924

(56) References Cited

U.S. PATENT DOCUMENTS

| | | | | |
|---|---|---|---|---|
| 3,291,442 A | * | 12/1966 | Cranage | 285/83 X |
| 4,124,228 A | * | 11/1978 | Morrison | 285/1 |
| 4,452,472 A | | 6/1984 | Crase | |
| 4,880,257 A | * | 11/1989 | Holbert, Jr. | 285/2 |
| 4,971,365 A | * | 11/1990 | Schultz | 285/2 |
| 5,158,142 A | | 10/1992 | Miszewski et al. | |
| 5,170,847 A | * | 12/1992 | Mims et al. | 285/306 X |
| 5,630,570 A | * | 5/1997 | Lacroix et al. | 285/924 X |
| 5,695,009 A | | 12/1997 | Hipp | |

FOREIGN PATENT DOCUMENTS

| | | |
|---|---|---|
| EP | 0 686 753 A2 | 6/1995 |
| GB | 2 294 714 A | 11/1994 |
| NO | 305715 | 7/1999 |
| WO | WO 97/29270 | 2/1997 |

* cited by examiner

*Primary Examiner*—Lynne H. Browne
*Assistant Examiner*—David E. Bochna
(74) *Attorney, Agent, or Firm*—Knobbe Martens Olson & Bear LLP

(57) ABSTRACT

A releasable connector connects between coiled tubing, a pipe string or similar tubular string and a tool/piece of equipment. Two sleeve-shaped inter-connectable parts are configured to be releasable, wherein one is connected to the coiled tubing, and the other is connected to the tool/equipment. A locking device holds the two sleeve-shaped parts of the connector in a blocked non-released position, and a retaining sleeve keeps the locking device in its locking position. The retaining sleeve is axially displaceable for releasing the connector by a sufficient, axial displacing movement. A coaxial displaceable piston body with a transversal end surface can be influenced by fluid pressure in order to start a releasing process. The piston body has a spring, which resists the displacement of the piston and is arranged in a spring chamber. In an initial position of the connector, the spring chamber is filled with a medium which can be forced out through a cavity and an opening. Forcing the medium through the opening provides for a delay on the displacement of the piston body and the compression of the spring and, thus, a release delay.

4 Claims, 4 Drawing Sheets

RELEASABLE CONNECTOR

FIELD OF THE INVENTION

This invention relates to a releasable connector arranged to be inserted between coiled tubing, a pipe string or similar tubular string and a tool/piece of equipment, and arranged to release and be divided into two sleeve-shaped interconnectable parts, of which one is connected to the coiled tubing, and the other is connected to said tool/equipment, and in which the two sleeve-shaped parts of the connector are held together in a blocked non-released position by means of a locking device which is kept in its locked position by means of a retaining sleeve, which is axially displaceable on release, or the initial release, of the connector, said retaining sleeve releasing said locking device by a sufficient axial displacing movement, said locking device thereby initiating the release, said connector comprising internally a coaxial displaceable piston body with a transversal end surface, which can be actuated by fluid pressure in order to start the release process, and which influences, when being displaced, the locking device to release its locking effect and allow division of the connector into said two interconnectable parts.

When released intentionally, the connector is divided between its connecting ends, whereby the coiled tubing etc. is separated from the downhole tool.

BACKGROUND OF THE INVENTION

Such connectors are generally known in several embodiments, and are brought to function, i.e. brought to release, should, for example, the downhole tool jam and become stuck and resist withdrawal together with the coiled tubing/pipe string and the connector in undivided condition.

An example of a connector of this kind is disclosed in NO 180.552. The releasable locking means holding together two separable parts of the connector, here consists of a radially expandable locking ring, which is in a compressed, non-expanded condition in its locking position, blocking the two separable parts of the connector. In its locking position, the locking ring engages a lock mandrel included in the connector, and is surrounded by an axially displaceable retaining sleeve, which is shear-pinned in a non-displaceable position in the active position of the connector. Whenever it is desirable to release the connector for division into an upstream part, which may be extracted together with intact coiled tubing (pipe string), and a downstream part, which will remain in its position downhole together with the tool, an internal seat formed in a piston sleeve is used in a well-known manner, whereby a ball is released from a surface position to settle sealingly on the seat, after which drilling mud/drilling fluid or other fluid is pumped down under pressure from the surface to exert a considerable pressure on the reaction surface of the piston sleeve opposite the pressure, consisting of the ball surface of the ball and the seat surface opposite the direction of flow of the pressure fluid. By a certain pressure build-up upstream of the ball-/sphere-like sealing body cooperating with the seat of the piston sleeve, the piston sleeve is put into a displacing movement, whereby said retaining sleeve is subjected to an axial compressive force. The shear pins are sized to shear by for example the compressive force (e.g. equalling 70.3 kg/cm$^2$—1000 psi) achieved thereby. When the shear pins have been shorn, the piston sleeve and thereby the retaining sleeve are displaced until the latter is no longer surrounding the locking ring, but releases it. In its released condition the locking ring expands and releases the connector.

This known connector can release on unintentional pressure build-up inside the connector.

Unintentional pressure build-up, which may make the connector release, may occur during so-called underbalanced perforation. The formation pressure is lower than the hydrostatic pressure of the well before perforation.

A hydraulically releasable connector of the kind initially mentioned, is known from the Norwegian patent document No. 305.715. This known connector is arranged for the releasable connection of a tool to the end of coiled tubing. The casing of the connector is formed with two or more hydraulic channels for the transfer of hydraulic fluid from hydraulic lines run through the coiled tubing to said tool. The connector is retained in its connected position by means of a locking device which is secured by means of an axially displaceable sleeve, which again is retained in its securing position by means of transversal shear pins. The retaining sleeve is arranged as a piston-like hydraulically manoeuvrable means, and is provided with annular seals of different sealing diameters. These seals define annular areas on the piston-like retaining sleeve, and these piston areas each have a hydraulic channel arranged thereto. The retaining sleeve is subjected to an axial force, equalling the sum of the product of the pressure in each of the hydraulic channels and the respective annular piston area. The shear pins are sized to be brought to break, whenever both annular piston areas are subjected to hydraulic working pressure. This connector also has not got any delaying means (such as a spring and/or viscous liquid) on the underside of the piston-like retaining sleeve.

SUMMARY OF THE INVENTION

Thus, the object of this invention has been to arrange it so that a brief pressure increase inside the connector will not necessarily result in full release and division of the connector into two separate parts.

The object is realized, according to the invention, by means of a connector of the kind specified in the introductory part of Claim 1, which distinguishes itself through the features appearing from the characterizing part of Claim 1.

On undesirable pressure build-up in the connector, the return spring of the piston may be compressed somewhat, and the shear pin(s) may shear, but the release-delaying device according to the invention prevents the complete compression of the return spring, which is necessary for the release of the locking mechanism.

The release-delaying device consists of a spring chamber filled with lubricating grease, in which the piston forces, during its displacement and compression of the spring, the lubricating grease (or other particularly viscous liquid or pumpable substance) out through a choked opening, preferably adjustable in size, which resists accelerated rate of extrusion, thus delaying the displacement of the piston, and thereby the compression of the spring, for a period of time, during which the locking ring or other locking mechanism still has not been brought completely out of its locking position when the unintentional pressure increase ceases. When all of the lubricating grease/liquid has been forced out of the spring chamber, the delaying means has been spent, whereby there is nothing else but the return spring attempting to hold back the piston. If the compressive force, acting axially on the piston, exceeds the counter-force of the spring, the piston is displaced during the compression of the spring, and completes its stroke to release the locking ring/mechanism.

If it is desired to release the connector intentionally and consciously, the reaction surface of the piston is exposed to high pressure, e.g. 70.3 kg/cm$^2$(1000 psi), for a period of time, which is known, from experience, to exceed the time for the forcing out of the lubricating grease from the spring chamber.

BRIEF DESCRIPTION OF THE DRAWINGS

A non-limiting example of a preferred embodiment will be explained in further detail in the following with reference to the drawings, in which:

FIG. 1 illustrating the connector in an active position, in which its two connected parts are locked to each other;

FIG. 2 illustrating an intermediate position, in which the shear pins are broken, and the displacement of the piston and compression of the return spring has been initiated;

FIG. 3 showing an end position, in which the locking mechanism (the locking ring) has been released, and in which the release of the connector cannot be postponed any longer. The connected condition cannot be re-established.

DETAILED DESCRIPTION OF THE INVENTION

Figure 1:
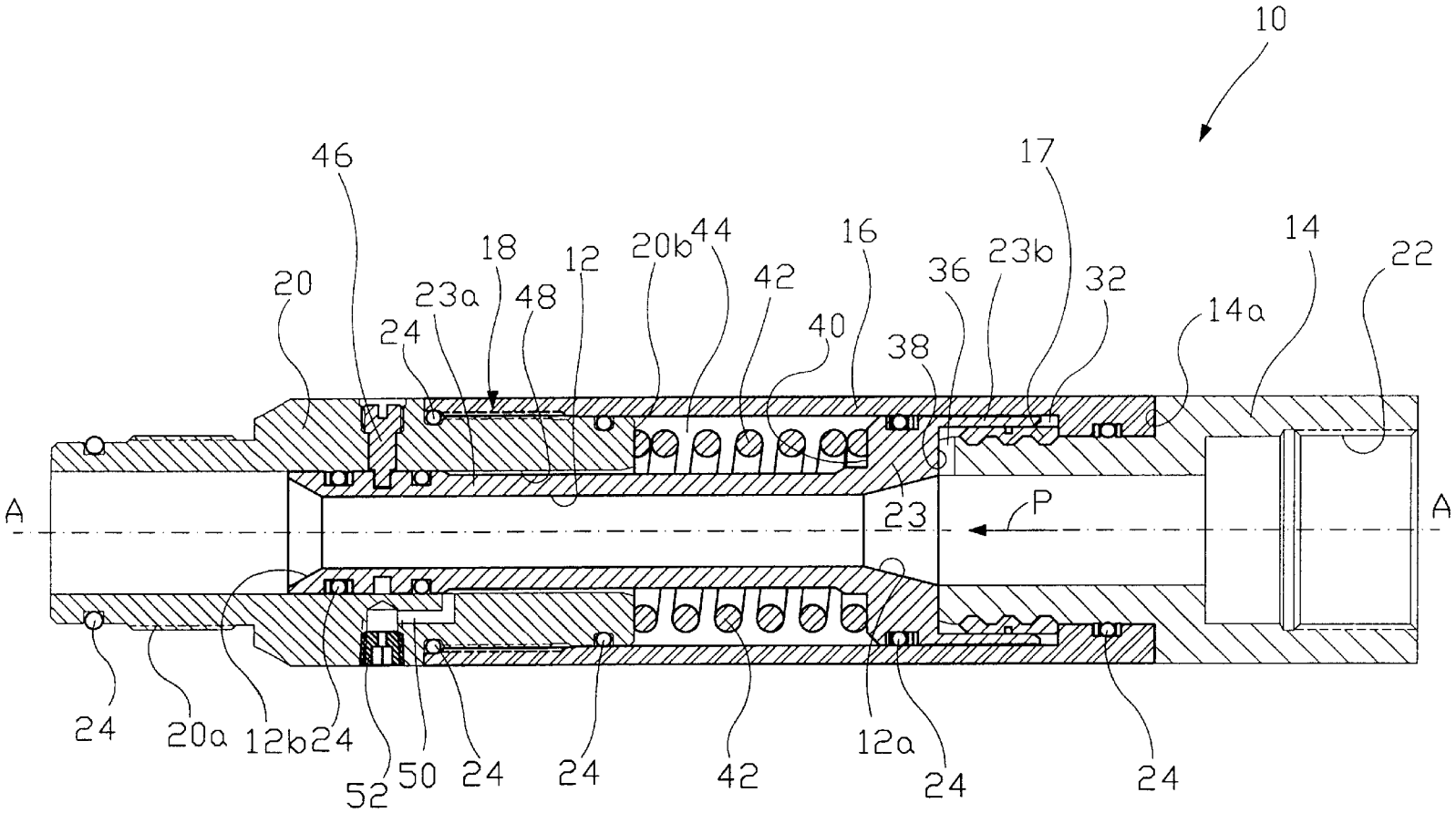
FIGS. 1–3 show axial sections through a connector in various functional positions thereof.

Referring to the drawings, a straight, elongate connector, generally identified by the reference numeral 10, is formed with a passage 12 for liquid, extending axially therethrough. The connector comprises two sleeve-shaped parts 14 and 16, held together by means of a releasable locking ring 17, whose locking effect may be brought to cease in the manner explained in further detail below.

Over a longitudinal portion the sleeve-shaped 16 is screwed by threads 18 together with a third sleeve part 20, and the parts 16, 20 appear and are considered as one functional unit 16,20, in which the free (left-hand) end portion 20*a* forms an externally threaded connecting pin of reduced diameter, for the connection of a replaceable tool/piece of equipment (not shown).

The upstream, sleeve-shaped part of the connector 10 has an internally threaded, widened box cavity 22 for the connection of the threaded extremity of coiled tubing or of a pipe string (not shown).

A piston 23 with a longitudinal, tubular piston rod 23*a* is displaceably mounted in an axial cylinder chamber defined by an inner surface of the sleeve-shaped part 16 telescopically overlapping the second sleeve-shaped part 14 extending axially in the extension thereof.

Within this area, in which the two interconnected disconnectable sleeve-shaped parts 14 and 16,20 of the connector overlap telescopically, there is arranged, between the two, a locking ring 17 which is split and is formed of a resilient material, so that the ring 17 will expand radially when it is not influenced by radial inward forces.

In internal/external circumferential grooves in the relatively displaceable individual parts of the device, there are inserted, for sealing purposes, gaskets/seals 24, for example in the form of O-rings.

At its internal circumferential portion, the radially expandable locking ring 17 is formed with waved ridges 26 and intervening grooves 28, which engage corresponding grooves 30, or which are matchingly engaged, in a position-fixing manner, by ridge-shaped portion formed externally on the sleeve part 14.

Round the locking ring 17 there is an annulus 32, defined between the external surface of the first (right-hand) sleeve part 14, and the opposite internal surface portion of the second sleeve part 16,20.

Figure 2:
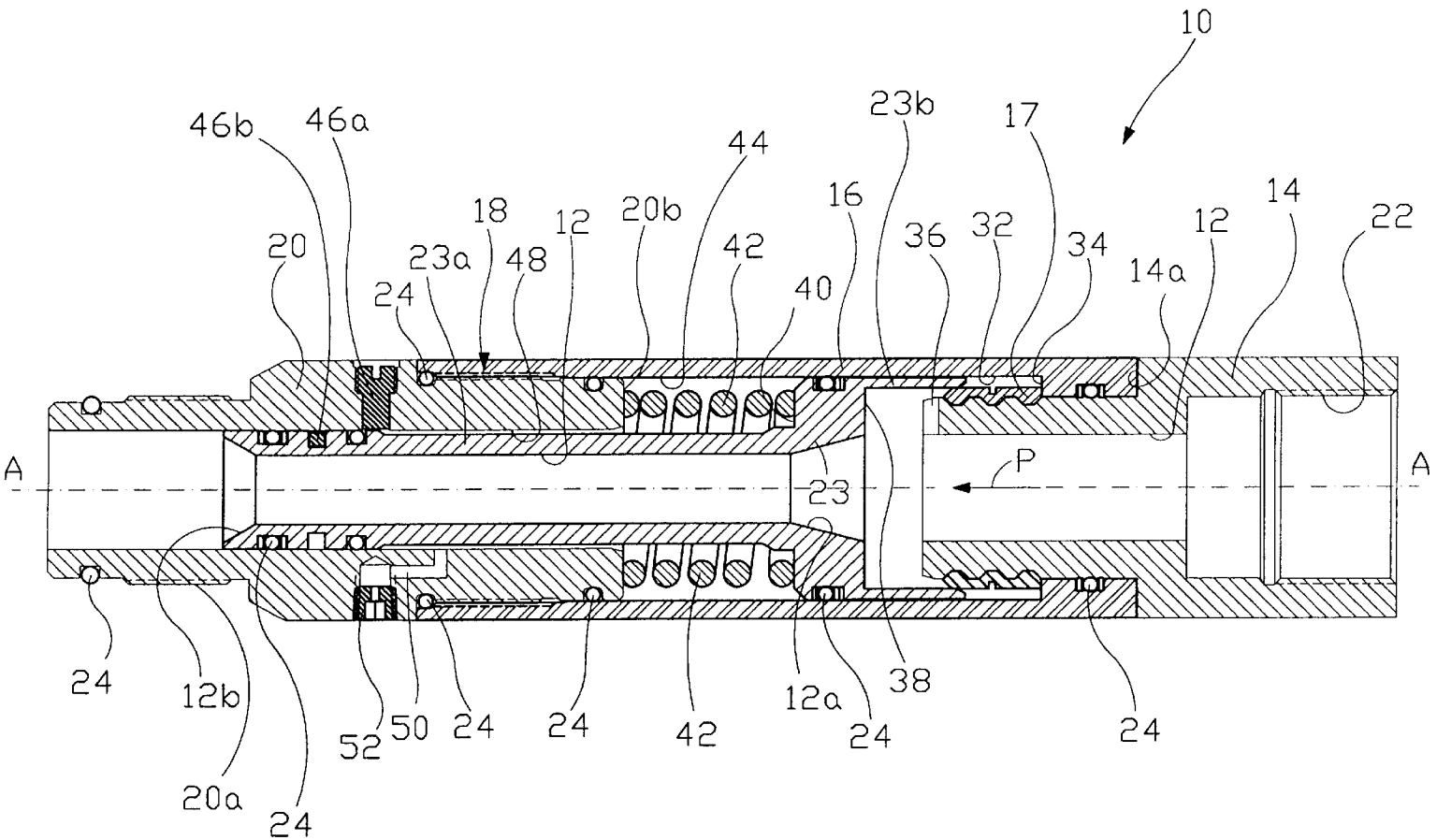
Figure 3:
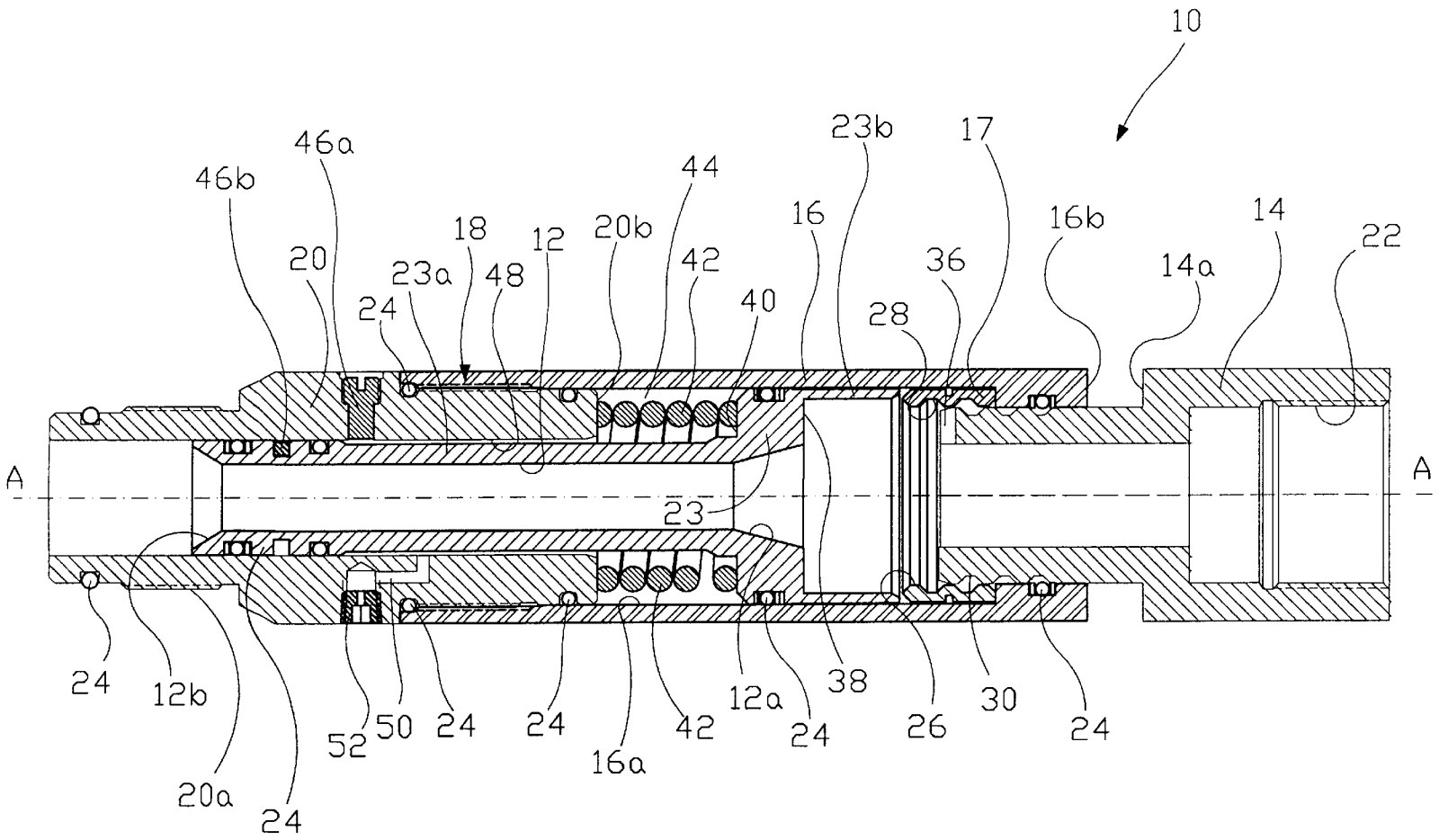
Figure 4:
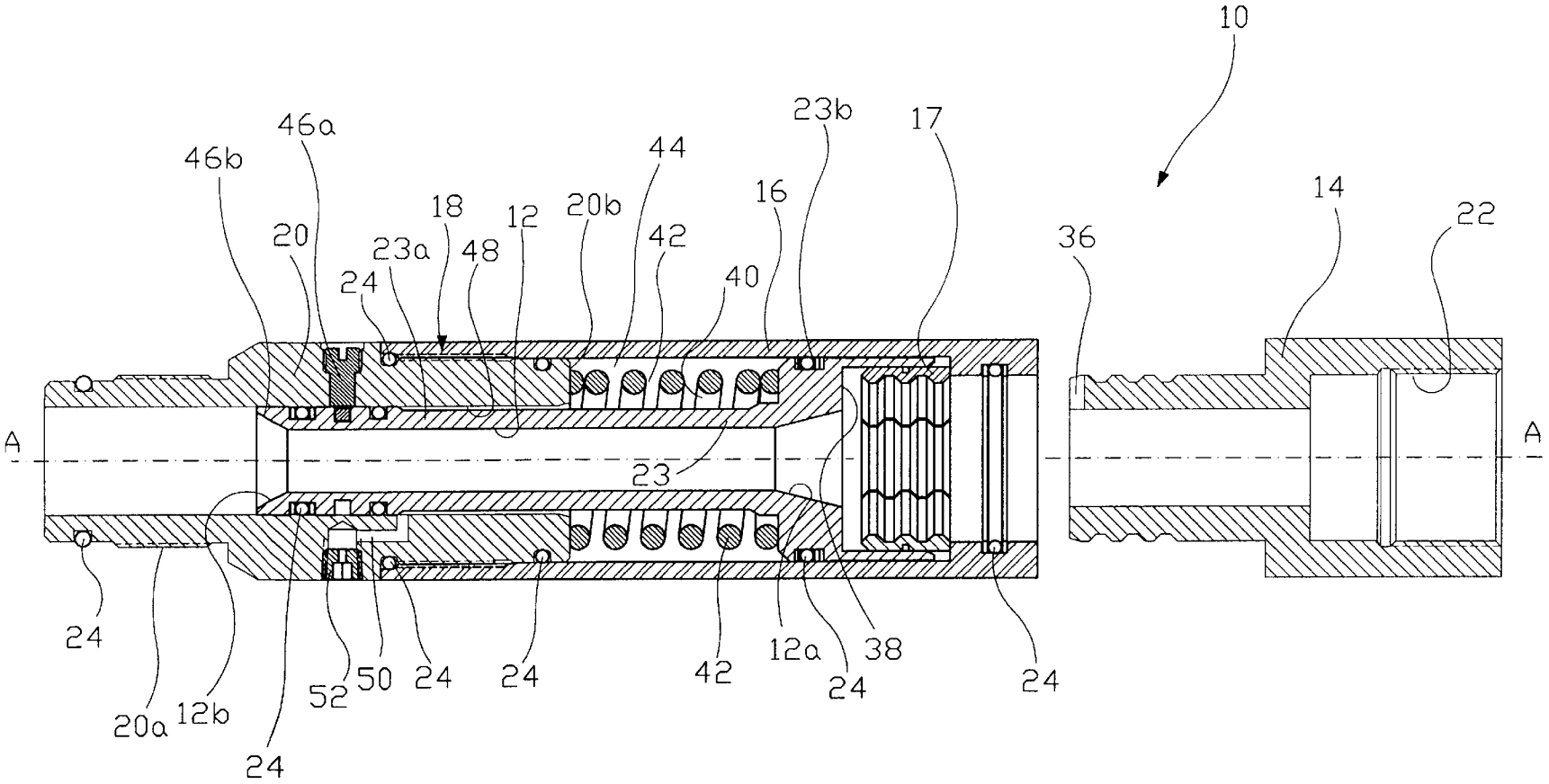
FIG. 4 shows the two main parts of the connector separated.

The outer, free box-shaped end portion of the first sleeve part 14 is connected to a narrower sleeve-shaped portion, in which the waved grooves 30 are formed, through a shoulder portion 14*a,* which is an annular stop portion on which the end surface 16*b,* FIG. 3, of the second sleeve part 16,20 rests supportingly, FIGS. 1 and 2, when the connector 10 is fitted together and is in use, or is in an intermediate position (FIG. 2).

When the connector 10 is fitted together, FIG. 1, an axially projecting (towards the right) peripheral, annular end portion 23*b* of the piston 23 essentially occupies the space inside the annulus 32, thereby keeping the locking ring 17 pressed radially inwards, so that it adopts the non-expanded stand-by/locking position, in which the locking ring 17 keeps the sleeve parts 14 and 16,20 of the connector 10 in an axially fixated, locking position, the locking ring 17 bearing supportingly, in a manner so as to block axial movement, by its right-hand end on an internal shoulder surface 34 formed in the second sleeve-shaped part 16,20, while at the same time the circumferential ridges 26 of the locking ring 17 are matchingly bearing in the corresponding, complementarily formed grooves 30 of the sleeve part 14.

The longitudinal axis of the releasable connector is identified by A—A, and the direction of flow of drilling fluid or other pumpable fluid is identified by P. Thus, the box cavity 22 is the upstream connecting portion of the connector and the end portion 20*a* its downstream connecting portion.

Through the piston 23 and the piston rod 23*a* thereof, the through bore 12 is formed with end portions different from the its general extent. Thus, there is a relatively short upstream bore portion 12*a,* tapering conically in the direction of flow P, and an even shorter downstream bore portion 12*b,* widening conically in the direction of flow P. Otherwise there are several bore sections differing from one another in diameter.

From the narrowest bore portion within the first sleeve part 14, there is a radial port 36 to allow pressurized fluid to influence the reaction surface 38 of the piston 23.

Between the annular surface 40 of the piston 23, which is parallel to and opposite the reaction surface 38, and an annular end surface 20*b* at a distance therefrom, there is inserted a helical compression spring 42 pressing against the piston head 23, opposite the arrow P, to retain it in the position shown in FIG. 1.

The spring 42 is arranged in an annulus 44 defined by the two opposed annular radial surfaces 20*b* and 40 and the internal surface of a longitudinal portion of the second sleeve-shaped part 16,20 of the connector and the external surface of the tubular piston rod 23*a*.

Between the tubular piston rod 23*a* and the sleeve portion 20 leading downstream, a shear pin connection 46 is established, depending on the applied force and comprising one or more radial shear pins 46, which engage the tubular walls of the sleeve part portion 20 and the piston rod 23*a,* and which are illustrated in a shorn condition in FIGS. 2 and 3, where the two separate non-connectable shear pin pieces are identified by 46*a* and 46*b*.

Over a longitudinal section of the downstream portion 20 of the second sleeve-shaped part 16,20, the piston rod 23*a* is sized with a somewhat reduced external diameter, so that over said section of its length there is formed an annulus 48, which places the spring chamber 44 in fluid communication with an angled channel 50 in the tubular wall of the sleeve part portion 20, and which leads to a choke valve 52, whose outlet opening is directed radially out from the tubular body 10 of the connector.

According to the present invention, the spring chamber is filled with lubricating grease or liquid, preferably viscous liquid, for which it will take a certain period of time to be forced out of the spring chamber 44 through the choke valve 52 via the annulus 48 and the channel 50. Such forcing out of lubricating grease/liquid will take place on displacement of the piston/piston rod unit 23,23*a* in the direction of flow P.

Such a linear displacing movement may be brought about intentionally by the supply, initiated from a surface position, of pressurized fluid, acting on the end surface 38 of the piston 23, opposite said direction of flow P, against the action of the compression spring 42.

The shear pin 46 may be sized to shear by an axial compressive force communicated by the piston rod 23*a* relative to the second (downstream) sleeve part 16,20 of the connector 10. The shearing force may correspond, with respect to the axial compressive force of the piston 23 and the piston rod 23*a,* to the force that the compressive spring 42 can resist before it starts to yield elastically and become compressed, FIG. 2, showing an intermediate position, in which the spring 42 has not been compressed to its maximum, and in which the locking ring 17 has not reached its radially expandable position, so that the locking effect is still maintained. Then it is possible to avoid unintentional release of the connector, so that intact string of coiled tubing, connector, in addition to connected tool/equipment (at 20*a*) can be recovered and brought up to the surface after a brief, great pressure build-up has been observed.

The pumping out of, for example, lubricating grease through the choke valve 52 slowing down the pump rate, will delay the displacement of the piston/piston rod unit 23,23*a* towards its end position (FIG. 3), which is favourable as regards unintentional shearing of the shear pins, piston displacement and compression of the spring. When the shearing of the shear pins and the displacement of the piston is brought about intentionally by the pumping down of pressurized drilling fluid, the compressive action on the piston 23 is maintained until the delaying device 44,48,50, 52 has ceased its action (lubricating grease has been forced out of the spring chamber 44), and the compression spring 42 has been maximally compressed, and the releasable connection of the two main parts of the connector, the sleeve-shaped parts 14 and 16,20, has been released.

The choke opening or any hole of a reduced area of through-put relative to the size of the channel, may be adjustable in size.

By intentional release of the connector 10 and irremediable division thereof into separate sleeve parts 14 and 16,20, operation at a fluid pressure of 70.3 kg/cm$^2$(1000 psi) should be maintained for a somewhat prolonged period of time, so that the shear pin(s) 46 is (are) brought to break first, after which the piston/piston rod unit 23,23*a* is allowed to be displaced, to concurrently press out lubricating grease etc. and compress the spring 42 into the releasing position in FIG. 3, in which the locking ring 17 has expanded radially. In this releasing position the compressed spring 42 cannot force the peripheral annular extension 23*b* of the piston 23 radially inwards immediately outside the outer jacket of the locking ring 17. Through the relative positioning of the peripheral annular extension 23*b* of the piston 23, the locking ring 17 and the engaging portion 30 of the sleeve part 14 opposite the locking ring 17, as shown in FIG. 2, the restoring of the active position of the connector 10 is made possible, because the locking ring 17 has not expanded radially and adopted its inactive position. Thus, when a brief, great pressure build-up is over, the position of the connector 10 will be as shown in FIG. 2, with the exception, however, that the shear pin(s) 46 is (are) broken.

What is claimed is:

1. A releasable connector arranged to be connected between coiled tubing, a pipe string or similar tubular string and a tool/piece of equipment, comprising:

two sleeve-shaped inter-connectable parts configured to be releaseable, of which one is connected to the coiled tubing, and the other is connected to said tool/equipment;

a locking device configured to hold the two sleeve-shaped parts of the connector in a blocked non-released position;

a retaining sleeve configured to keep the locking device in its locking position, wherein the retaining sleeve is axially displaceable for releasing the connector, said retaining sleeve releasing said locking device by a sufficient, axial displacing movement, said locking device thereby initiating the release; and a coaxial displaceable piston body with a transversal end surface, which can be influenced by fluid pressure in order to start a releasing process, and which, on displacement, influences the locking device to release its locking effect and allow division of the connector into said two inter-connectable parts, wherein the piston body has a spring arranged thereto, which resists the displacement of said piston, and is arranged in a spring chamber, whose one defining surface forms a transversal surface of the piston body, and wherein the initial position of the connector the spring chamber is filled with a medium for which there is provided a cavity receiving medium forced out and guiding it through an opening, said forcing out of the medium through the opening providing a delay on the displacement of the piston body and the compression of the spring means, and thus a release delay.

2. The connector according to claim 1, wherein the medium is selected from a group consisting of lubricating grease and a viscous liquid.

3. The connector according to claim 1, wherein extending downstream from the spring chamber, there is an annulus, which extends over part of the axial length of said second sleeve-shaped part, and which communicates with a possibly angled transversal channel ending in a choke opening, choke valve or other hole for the forcing out of the medium, with which the spring chamber is filled.

4. A releasable connector arranged to be connected between coiled tubing, a pipe string or similar tubular string and a tool/piece of equipment, comprising:

two sleeve-shaped inter-connectable parts configured to be releasable, of which one is connected to the coiled tubing, and the other is connected to said tool/equipment;

a locking device configured to hold the two sleeve-shaped parts of the connector in a blocked non-released position;

a retaining sleeve configured to keep the locking device in its locking position, wherein the retaining sleeve is axially displaceable for releasing the connector, said retaining sleeve releasing said locking device by a sufficient, axial displacing movement, said locking device thereby initiating the release; and a coaxial displaceable piston body with a transversal end surface, which can be influenced by fluid pressure in order to start a releasing process, and which, on displacement, influences the locking device to release its locking effect and allow division of the connector into said two inter-connectable parts, wherein the piston body has a spring arranged thereto, which resists the displacement of said piston, and is arranged in a spring chamber, whose one defining surface forms a transversal surface of the piston body, and wherein the initial position of the connector the spring chamber is filled with a medium for which there is provided a cavity receiving medium forced out and guiding it through an opening, said forcing out of the medium through the opening providing a delay on the displacement of the piston body and the compression of the spring and thus a release delay, wherein the piston body is connected to one sleeve-shaped part of the connector by at least one transversal shear pin, which is sized to withstand a load preferably corresponding to an axial compressive load, by which the spring arranged to the piston body will start to become compressed.

* * * * *